US005140874A

United States Patent [19]

Junkers

[11] Patent Number: 5,140,874

[45] Date of Patent: Aug. 25, 1992

[54] FLUID-OPERATED WRENCH

[76] Inventor: John K. Junkers, 7 Arrowhead La., Saddle River, N.J. 07540

[21] Appl. No.: 739,820

[22] Filed: Aug. 2, 1991

Related U.S. Application Data

[63] Continuation-in-part of Ser. No. 611,168, Oct. 8, 1990, abandoned.

[51] Int. Cl.[5] ..... B25B 13/46

[52] U.S. Cl. ..... 81/57.39; 81/55

[58] Field of Search ..... 81/55, 57.39

[56] References Cited

U.S. PATENT DOCUMENTS

| | | | |
|---|---|---|---|
| 3,941,017 | 3/1976 | Leniser et al. | 81/57.39 |
| 4,448,096 | 5/1984 | Collins | 81/57.39 |
| 4,706,527 | 11/1987 | Junkers | 81/57.39 |
| 4,846,028 | 7/1989 | Junkers | 81/51.39 |
| 4,854,197 | 8/1989 | Walton | 81/57.39 |
| 4,982,626 | 1/1991 | More et al. | 81/57.39 |

*Primary Examiner*—James G. Smith
*Attorney, Agent, or Firm*—Michael J. Striker

[57] ABSTRACT

A hydraulic wrench has a housing, fluid-operated drive means, a ratchet turnably mounted in the housing and connected with the drive means so as to be turned by the latter, the ratchet being formed as a one-way ratchet so that when going from loosening of a threaded connector to tightening of a threaded connector and vice versa, the housing together with the ratchet is to be turned over. A first engaging element is connected with the ratchet so as to loosen a threaded connector on one side of the housing and to tighten a threaded connector on the other side of the housing. The first engaging element is engageable with a threaded connector to be loosened or tightened. A second engaging element is located at opposite sides of the housing. A reaction member extends so as to transfer a reaction force to a stationary object during the tightening and loosening so that the housing becomes stationary while the first engaging element turns. The reaction member engages with the second engaging element during the tightening at one side of the housing and during the loosening at the other side of the housing.

10 Claims, 2 Drawing Sheets

A
B 41
42
43
44
45
46
47
48
49
50
51
52
53
54
55
56
57
59
61
62
63
64

FLUID-OPERATED WRENCH

CROSS-REFERENCE TO RELATED APPLICATION

This application is a continuation-in-part of application Ser. No. 611,168 filed on Oct. 8, 1990 now abandoned.

BACKGROUND OF THE INVENTION

The present invention relates to fluid-operated wrenches or torque tools.

More particularly, it relates to a wrench which has a reaction element and which does not have to be turned over when switching from the process of tightening a threaded connector to the process of loosening the threaded connector.

Hydraulic wrenches of the above mentioned general type are known in the art. One of such fluid-operated wrenches is disclosed, for example, in my U.S. Pat. No. 4,706,527. The wrench disclosed in this reference has a two-way ratchet which permits the above mentioned retention of the tool on the threaded connector, regardless of whether the threaded connector is to be tightened or loosened. The two-way ratchets used in such tools necessitate further research and development simply because two-way ratchets as they are commonly known frequently cannot be subjected to high force output of many fluid-operated torque wrenches. It is believed to be clear that further improvements of the existing tools would be desirable.

SUMMARY OF THE INVENTION

Accordingly, it is an object of the present invention to provide a fluid operated tool which avoids the disadvantages of the prior art.

More particularly, it is an object of the present invention to provide such a fluid-operated tool which has to be turned around when switching from the tightening process of the threaded connector to the loosening process of the same and which also has a reaction member attached around a drive axis of the ratchet.

In keeping with these objects and with others which will become apparent hereinafter, one feature of the present invention resides, briefly stated, in a fluid-operated power wrench which has a housing, a fluid-operated drive, a ratchet turnably mounted in the housing and connected with the drive to be turned by the latter, the ratchet being formed as a one-way ratchet so that when going from loosening of a threaded connector to tightening of a threaded connector and vice versa, the housing together with the ratchet is to be turned over, first engaging means connected with the ratchet so as to loosen a threaded connector on one side of the housing and to tighten the threaded connector on the other side of the housing, the first engaging means being engageable with a threaded connector to be loosened or tightened, two second engaging means located at opposite sides of the housing; and reaction means extendable as to transfer the reaction force to a stationary object during the tightening and loosening so that the housing becomes stationary while the first engaging means turn, and connectable with the second engaging means during the tightening and with the second engaging means during the loosening of the threaded connector at opposite side of the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figures 1, 2:
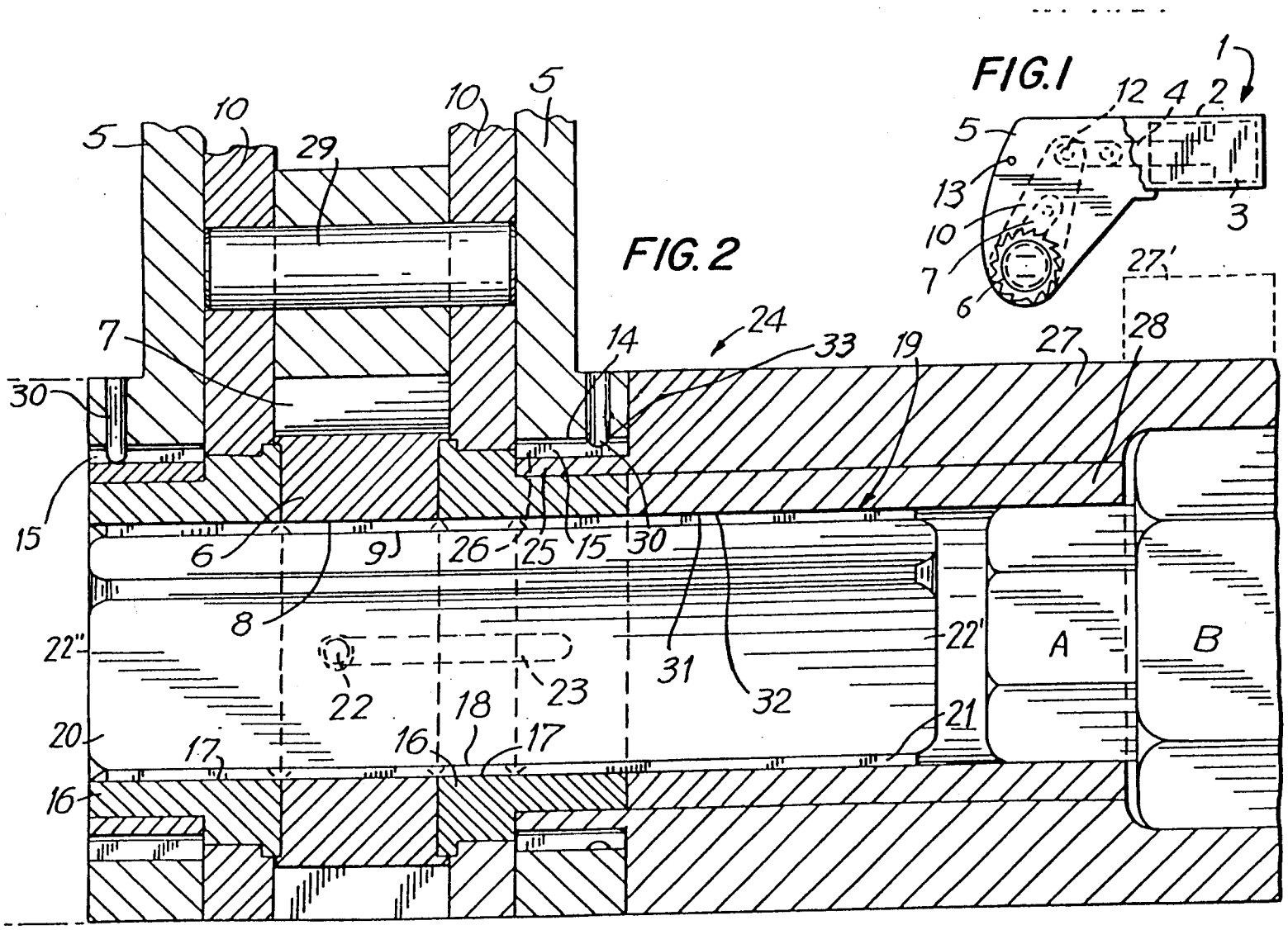
FIG. 1 is a view showing schematically a fluid-operated tool in accordance with the present invention.
FIG. 2 is a view showing a section of the fluid-operated tool of FIG. 1.

A fluid-operated wrench in accordance with the present invention has a fluid-operated drive which is identified as a whole with reference numeral 1. The drive includes, as usual, a cylinder 2 and a piston 3 movable in the cylinder 2 and provided with a piston rod 4. Two side plates 5 are connected in a known manner with the cylinder 2 of the drive and form together with the cylinder 2 a housing of the tool.

The fluid-operated tool further has a ratchet-pawl mechanism which includes a ratchet 6 and a pawl 7 engaging one another through respective teeth. The ratchet 6 is provided with an inner opening 8. The opening 8 is preferably nonround and its wall has a plurality of engaging formations, for example splines 9. The pawl 7 is turnably mounted on a pin 29 which is held in two drive plates 10. The drive plates 10 surround the pawl on both opposite sides and are sandwiched between the side plates 5. The upper ends of the drive plates 10 are pivotally connected with the end of the piston rod 4 of the drive 1, for example by a pin 12. The side plates 5 are also connected with one another for example by a pin 13. Each side plate is provided with an inner opening 14. Two bushings 16 are arranged at both sides of the ratchet 6 and have inner openings 17 provided with engaging formations for example splines 18.

The fluid-operated tool in accordance with the present invention further has first engaging means provided for engaging a threaded connector and identified as a whole with reference numeral 19. The first engaging means can be formed as an elongated rod 20 having a plurality of splines 21. The rod 20 and its splines 21 are designed so that the splines 21 engage with the splines 9 of the ratchet 6 and the splines 18 of the bushings 16 and the rod 20 can displace in an axial direction of the tool through the opening 8 of the ratchet 6 and the opening 17 of the bushings 16. Both ends 22',22'' of the rod 20 have a shape required for engaging a threaded connector to be tightened or loosened. For example, the ends can be provided with a hexagonal opening, with a hexagonal head, or with a shape permitting attachment of a socket for engaging with a threaded connector, etc. The rod 20 can be axially displaced so that its end 22' extends axially outwardly beyond the housing as shown in FIG. 2 at the right side, or in an opposite direction so that its left end 22" extends outwardly beyond of the housing at the left side. In each position the rod 20 can be fixed for example by a threaded pin or screw 22 which extends through a threaded opening of the ratchet 6 and engages in an elongated groove 23 of the rod 22 so as to firmly abut against a bottom of the groove 23 and thereby to tighten the rod.

The fluid-operated tool of the invention further has second engaging means provided for engaging a reaction member. The above second engaging means is arranged at opposite axial sides of the housing. In the shown embodiment each second engaging means is formed as splines 15 provided in the openings 14 of each side plate 5. It is to be understood that the second engaging means can be formed in many other ways, to engage the reaction member, for example as an engaging recess, an engaging projection, etc.

The tool is provided with a reaction member. In the embodiment of FIG. 2 the reaction member 24 includes a ring 25 which is located in the opening 14 of the side plate 5 and has splines 26 engaging with the splines 15. Of course the ring can be provided with other formations (a projection, a recess, etc.) to engage with the second engaging means. A reaction socket 27 is connected with the ring 25 and in the embodiment shown in FIG. 2 formed integrally of one piece with the ring. A turning socket 28 provided with inner splines is located inside the reaction socket 27. The turning socket 28 has an inner opening 31 provided with splines 32 engageable with the splines 21 of the rod 20. A threaded pin 30 can extend through a threaded opening in the side plate 5 and engage in a depression 33 in the ring 25 so as to fix the reaction member 24 to the plate 5.

The operation of the tool is illustrated by an example of tightening of foundation bolts with one nut A tightened on top of another nut B to assure that the connection does not loosen by vibrations. When the nut B is tightened to a required torque, for example by reacting against an adjacent stationary object, the rod 20 is pushed to one side of the housing as shown in FIG. 2 and fixed in this position by the threaded pin 22. The end 22' of the rod engages the turning socket 28. Then, the drive 1 is actuated, the piston 3 with the piston rod 4 are displaced in the cylinder 2, the drive plates 10 are turned and turn the drive pawl 7 which turns the ratchet 6. The ratchet 6 turns the rod 20 and thereby the turning socket 28 and the nut A, while the reaction socket 27 having a hexagonal end opening is held immovably on the nut B. When it is necessary to loosen a threaded connector, the threaded pin 22 is released, the rod 20 is pushed to the other side of the housing so that its other end 22" projects outwardly beyond the left side plate 5, and the threaded pin 22 is tightened to fix the rod 20 in its new position. The reaction member 24 and the turning socket 28 are placed on the opposite axial side of the housing. The turning socket 28 is fitted on the left portion of the rod 20, while the ring 25 of the reaction member 24 engages by its splines 26 with the splines 15 of the opening 14 in the left side plate 5. The reaction member 24 is then fixed by the left threaded pin 30. Then again the drive 1 is actuated, the piston rod 4 turns the drive plates 10 which turn the pawl 7 which turns the ratchet 6. The ratchet turns the rod 20 and thereby the turning socket 28 and finally the nut to loosen the latter, while the reaction socket 27 is held immovably on a neighboring object.

It is well known that during the operation of the fluid-operated tools it is necessary to abut with a reaction element against an object for example a neighboring nut or bolt, flange, etc. When during tightening of a threaded connector it is necessary to react against a neighboring object, the reaction member 24 is mounted as shown in the drawing at the right side of the housing and engages with the right engaging means 15. When it is necessary to loosen a threaded connector, the reaction member 24 is removed from the tool and mounted at the left side of the housing and engages with the left engaging means 15.

As described hereinabove, the first engaging means 19 is displaceable along the axis of the ratchet and cannot rotate relative to the ratchet. It is performed here by interengaging splines on the respective parts. However, it is to be understood that this can be achieved in many different ways for example by forming the openings in the ratchet 6 and the bushes 16 of a non-round shape, and respectively forming the rod 20 non-round as well, such as rectangular, hexagonal and other shapes.

Figures 3, 4, 5, 6:
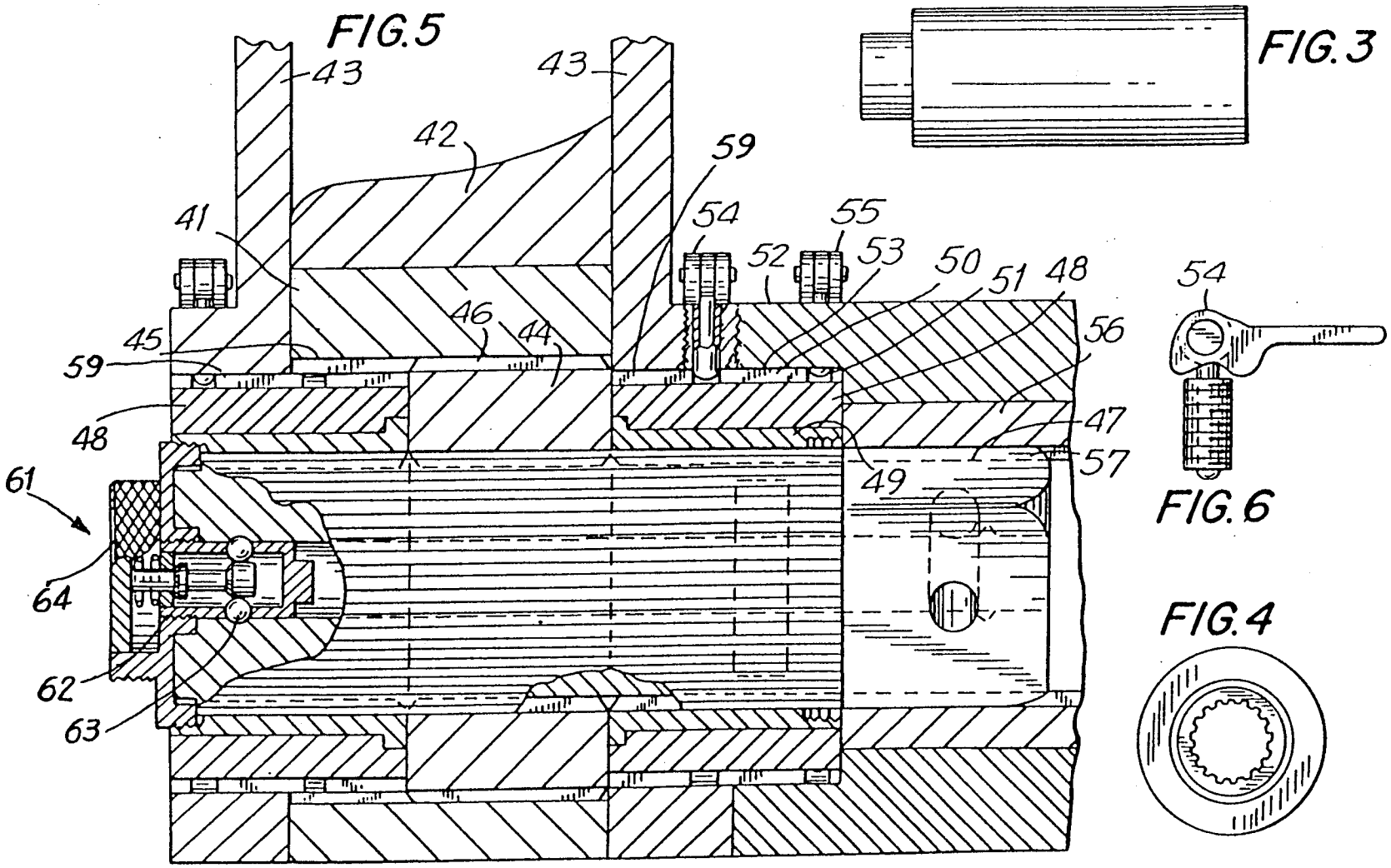
FIG. 3 is a side view of a reaction arm of the inventive fluid-operated tool.
FIG. 4 is a view from below of the reaction arm of FIG. 3.
FIG. 5 is a view showing a fluid-operated tool in accordance with a further embodiment of the present invention.
FIG. 6 is a view showing a retaining element of the inventive fluid-operated tool.

In the embodiment shown in FIG. 5 a pawl 41 is held by a drive plate 42 which is sandwiched between two side plates 43, and engages with a ratchet 44. The pawl 41 and the ratchet 44 are provided with interengaging formations 45 and 46 respectively which can be formed as splines, sawteeth, etc. to permit a longitudinal displacement of the ratchet 44 relative to the pawl 41 in an axial direction of the ratchet. The first engaging means is again formed by a rod identified with reference numeral 47 and reversible so that its one end or another end extend outwardly beyond the respective side of the housing. The second engaging means 53 are formed as splines 59 provided in the side plates 43.

The reaction member includes a reaction sleeve 48 arranged on a bushing 49 and having outer splines 50 and two depressions 51 spaced from one another in an axial direction. The reaction sleeve 48 engages by its splines 50 with the splines 59 of the side plates 43. The reaction member further has a reaction socket 52 formed in this embodiment as a separate member. The reaction socket 52 is mounted on the sleeve 48 by interengagement of the splines 53 of the reaction socket 52 with the splines 50 of the reaction sleeve 48. The reaction sleeve 48 is retained on the side plate 43 by a retainer 54, while the reaction socket 52 is retained on the reaction sleeve 48 by a retainer 55 engaging in respective depressions 51. A turning socket 56 is turnably located inside the reaction socket 52 and its splines 57 engage the surplus of the rod 47.

The ratchet 44 and the bushings 49 at both sides of the tool have inner engaging formations for example splines which engage with outer engaging formations, for example splines of the rod 47, so that the rod can displace axially without turning relative to the ratchet and the bushings.

In this embodiment when it is necessary for example to tighten a threaded connector, the rod 47 is pushed to the right and fixed in this position, and the drive ratchet 44 with the sleeves 48 and bushings 49 is pushed to the right in the position shown in FIG. 5. When it is necessary, however, to loosen a threaded connector, the rod 47 is pushed to the left so that its left end extends outwardly beyond the left side plate 43, and the drive ratchet 44 together with the sleeves 48 and the bushings 49 is also pushed to the left, so that the left sleeve 48 and the bushing 49 extend outwardly beyond the left plate 43. The reaction socket 52 with the turning socket 56 are removed from the right sleeve 48 and placed on the left sleeve 48 at the left side of the tool.

A retainer 61 prevents axial withdrawal of the interior parts of the tool from the housing. The retainer 61 can include an inner sleeve 62 retained by balls 63 in the central bore of the rod 47 and a nut 64 screwed on the sleeve 62 and also screwable in the threaded end portion of the opening in each bushing 49. When the rod 47 projects to the right, the retainer 61 is arranged at the left side, and vice versa. During the operation the retainer 61 rotates together with the ratchet 44, the bushings 49 and the rod 47 relative to the side plates 43. The same or similar retainer can be provided in the embodiment of FIG. 2.

The reaction elements of this tool can react against any adjacent stationary object, including a part of the fastening device disclosed in U.S. Pat. application Ser. No. 07/570,142 filed on Aug. 17, 1990, in particular the top nut of the device.

It will be understood that each of the elements described above, or two or more together, may also find a useful application in other types of constructions differing from the types described above.

While the invention has been illustrated and described as embodied in a hydraulic tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A hydraulic wrench comprising a housing; fluid-operated drive means; a ratchet turnably mounted in the housing and connected with said drive means so as to be turned by the latter, said ratchet being formed as a one-way ratchet so that when going from loosening of a threaded connector to tightening of a threaded connector and vice versa, said housing together with said ratchet is to be turned over; first engaging means connected with said ratchet so as to loosen a threaded connector on one side of said housing and to tighten a threaded connector on the other side of said housing, said first engaging means being engageable with a threaded connector to be loosened or tightened; two second engaging means located at opposite sides of said housing; and reaction means extendable so as to transfer a reaction force to a stationary object during the tightening and loosening so that said housing becomes stationary while said first engaging means turn, said reaction means being engageable with one of said second engaging means at one side of said housing during the loosening and with the other of said second engaging means on the other side of said housing during the tightening of the threaded connector.

2. A fluid-operated wrench as defined in claim 1; and further comprising means forming a throughgoing passage through the hydraulic wrench, said first engaging means being arranged axially movably between a first position located on said one side of said housing and a second position located on said other side of said housing and being movable through said passage between said first and second positions.

3. A fluid-operated wrench as defined in claim 2, wherein said passage includes a first passage formed in said ratchet so that said first engaging means being movable through said first passage in said ratchet.

4. A fluid-operated wrench as defined in claim 3, wherein said passage includes a second passage formed inwardly of said second engaging means, said first engaging means being movable between said first and second positions through said first and second passages.

5. A fluid-operated wrench as defined in claim 4, wherein said passage includes a third passage formed in said reaction means, said first engaging means being movable between said first and second positions through said first, second and third passages.

6. A fluid-operated wrench as defined in claim 1, wherein said said reaction means is formed as one-piece integral member.

7. A fluid-operated wrench as defined in claim 1, wherein said reaction means includes one reaction portion which is engageable with each of said second engaging means, and another reaction portion which is connectable with said one reaction portion and extendable so as to transfer a reaction force to a stationary object.

8. A fluid-operated wrench as defined in claim 1; and further comprising means forming a throughgoing passage extending through the wrench, said reaction member having at least a portion which is at least partially displaceable in and along said passage.

9. A fluid-operated wrench as defined in claim 2; and further comprising guiding means allowing displacement of said first engaging means through said passage in an axial direction and at the same time preventing turning of said first engaging means relative to said ratchet.

10. A hydraulic wrench as defined in claim 1, wherein said ratchet has an axis, said first engaging means being axially movable between a first position located on one axial side of said housing and a second position located on the other axial side of said housing, said two second engaging means being located at two opposite axial sides of said housing so that said reaction means is engageable with one of said second engaging means at one axial side of said housing during the loosening and with other of said second engaging means on the other axial side of said housing during the tightening of the threaded connector.

* * * * *